US007870619B2

(12) United States Patent
Conrad, III et al.

(10) Patent No.: US 7,870,619 B2
(45) Date of Patent: Jan. 18, 2011

(54) POTTY TRAINING DEVICE

(75) Inventors: Joseph Michael Conrad, III, 1385 Kimblewick Rd., Potomac, MD (US) 20854; Kurt Gans Briscoe, South Orange, NJ (US)

(73) Assignee: Joseph Michael Conrad, III, Potomac, MD (US)

( * ) Notice: Subject to any disclaimer, the term of this patent is extended or adjusted under 35 U.S.C. 154(b) by 950 days.

(21) Appl. No.: 11/622,718

(22) Filed: Jan. 12, 2007

(65) Prior Publication Data

US 2007/0151009 A1 Jul. 5, 2007

Related U.S. Application Data

(63) Continuation-in-part of application No. 11/394,091, filed on Mar. 31, 2006, now abandoned.

(60) Provisional application No. 60/682,829, filed on May 20, 2005.

(51) Int. Cl.
*E03D 9/00* (2006.01)

(52) U.S. Cl. ..... 4/300.3; 4/252.1

(58) Field of Classification Search ..... 4/300.3, 4/252.1, 658, 652; 248/205.3; 52/34–5, 52/58, 273, 287.1; 40/661.08–661.09, 672; 211/113; 229/5.8
See application file for complete search history.

(56) References Cited

U.S. PATENT DOCUMENTS

| | | | | | |
|---|---|---|---|---|---|
| 1,682,798 | A | | 9/1928 | Richards | |
| 2,825,070 | A | | 3/1958 | Alexander et al. | |
| 3,566,421 | A | | 3/1971 | Waddle | |
| 4,292,763 | A | * | 10/1981 | Barnes et al. | 49/64 |
| 4,309,782 | A | * | 1/1982 | Paulin | 4/661 |
| 4,716,602 | A | | 1/1988 | Brickhouse | |
| 4,875,242 | A | | 10/1989 | Albrecht et al. | |
| 5,292,783 | A | | 3/1994 | Buchanan | |
| 5,391,423 | A | | 2/1995 | Wnuk | |
| 5,446,079 | A | | 8/1995 | Buchanan | |
| 5,489,470 | A | | 2/1996 | Noda | |
| 5,498,692 | A | | 3/1996 | Noda | |
| 5,562,964 | A | * | 10/1996 | Jones | 428/43 |
| 5,580,911 | A | | 12/1996 | Buchanan | |

(Continued)

FOREIGN PATENT DOCUMENTS

WO WO 2006/127444 11/2006

*Primary Examiner*—Khoa D Huynh
*Assistant Examiner*—Karen Younkins
(74) *Attorney, Agent, or Firm*—Norris McLaughlin & Marcus, P.A.

(57) ABSTRACT

A potting training device for preventing a potty-training child's urine stream from passing through the opening formed between the toilet seat and the toilet bowl. The device is made of a flexible, water-resistant, preferably non-porous sheet material, having a folding seam separating a urine-deflecting surface and a plurality of attachment tabs. An adhesive material is applied to the surface of each attachment tab and attaches the attachment tabs to the underside of the toilet seat. The sheet material, in its unattached flat configuration, is manipulated into a curved configuration that matches the curvature of the toilet seat, and is attached thereto. The potty training device is also not visible to the observer unless the toilet seat is lifted up, in a vertical position or viewed from a position to the rear of the attachment point when the toilet seat is down.

15 Claims, 6 Drawing Sheets

U.S. PATENT DOCUMENTS 5,599,858 A 2/1997 Buchanan
5,644,020 A 7/1997 Timmermann
5,849,401 A 12/1998 El-Afandi
5,853,876 A * 12/1998 Takano et al. ..... 428/352
5,910,545 A 6/1999 Tsai
6,081,937 A * 7/2000 Whitacre ..... 4/300.3
6,253,395 B1 * 7/2001 Quam ..... 4/658
6,289,527 B1 9/2001 Truettner
6,473,911 B2 11/2002 Weiss
6,514,602 B1 2/2003 Zhao
6,573,350 B1 * 6/2003 Markel et al. ..... 526/348
6,708,350 B2 3/2004 Devereux
2006/0260031 A1 11/2006 Conrad

* cited by examiner

POTTY TRAINING DEVICE

CROSS REFERENCE TO RELATED APPLICATIONS

This application is a Continuation-In-Part of U.S. application Ser. No. 11/394,091, filed on Mar. 31, 2006, which claims the benefit of U.S. Provisional Application Ser. No. 60/682,829, filed on May 20, 2005.

STATEMENT REGARDING FEDERALLY SPONSORED RESEARCH

Not applicable.

FIELD OF THE INVENTION

This invention is directed to a potty training device that functions as a urine deflector when attached to the underside of an adult sized toilet seat. The invention is designed to block the opening formed between the toilet seat and the toilet bowl. This invention reduces accidental wetting of clothing and the floor that occurs when a child's urine stream passes through the opening between the toilet seat and the toilet bowl.

BACKGROUND OF THE INVENTION

It is a major accomplishment for a child to reach the stage of sitting on an adult toilet during potty training. Obtaining control over the direction of urine flow, however, may take some time for a child to master, particularly a male child. When sitting on the toilet, a child's urine stream is not always directed into the toilet. There are occasions where the child's urine stream finds its way out of the toilet through the opening formed between the toilet seat and the toilet bowl. This results in the urine stream coming in contact with the child's pants or other clothing and the floor. This can be very upsetting for a child who is trying to do their best to stay dry and master going to the toilet, as well as the parent who has to continually clean up the mess.

Urine deflecting devices are not new to the art. Many of the known devices, however, are designed for adult males to prevent urine from splashing onto the seat during urination from a standing position. Few potty training devices address preventing the urine stream from passing through the opening between the toilet seat and toilet bowl.

Truettner (U.S. Pat. No. 6,289,527) discloses a molded plastic device that attaches to the underside of the toilet seat to prevent a child's urine stream from passing through the opening formed between the toilet bowl and the toilet seat. When attached to the underside of the toilet seat, the prior art device is not visible when the toilet seat is down, unless viewed from a position to the rear of the attachment point.

However, this prior art device is bulky, which results in increased manufacturing and sales costs. The device is also difficult to clean and frequent replacement increases expense for the consumer. Another drawback is that the prior art device has a fixed configuration. Given the variety of toilet seat shapes, the fixed configuration of the prior art device limits its compatibility with many toilet seats. Therefore, in order to accommodate the full range of toilet seat shapes, the prior art device would have to be manufactured in a variety of configurations, adding additional expense to manufacturing costs and to the consumer.

What is needed is an inexpensive device that is effective for blocking the opening formed between the toilet seat and the toilet bowl, that requires minimal manufacturing cost, and is easy to clean and replace without significant expense to the consumer. Additionally, there is a need for a single device that is flexible enough to match the curvature of any toilet seat and still remain hidden when the toilet seat is down, unless viewed from a position to the rear of the attachment point.

BRIEF SUMMARY OF THE INVENTION

The potty training device of the present invention effectively blocks the opening formed between the toilet seat and the toilet bowl and provides a simple and inexpensive solution to the above-described problems. In its unattached configuration, the potty training device of the present invention is a flat sheet material that is manipulated into a curved configuration and attached to the underside of a toilet seat, as shown in FIG. 7 and 8. The potty training device comprises a sheet material and a means for attaching the sheet material to the underside of a toilet seat. The sheet material further comprises a urine-deflecting surface, a folding seam, and a plurality of attachment tabs. Each attachment tab has layered thereon, an adhesive material, which provides the means for attaching the sheet material to the underside of the toilet seat. The device is made from any sheet material that is flexible, water resistant and preferably non-porous.

More specifically, as shown in FIG. 1, an embodiment of the device of the present invention comprises a sheet material 100 having a plurality of attachment tabs 1, a folding seam 3, a urine-deflecting surface 4 and an adhesive material 2 applied to the surface of each attachment tab 1. As shown in FIG. 7 and FIG. 8, the sheet material 100 is attached to the underside of a toilet seat 50 in a curved configuration and follows the curvature of the toilet seat 50 at the attachment point. The sheet material 100 may be any material that has the aforementioned characteristics of flexibility and water resistance. The sheet material 100 is also strong and flexible enough to resist tearing or breaking during manual manipulation and attachment, and provides rigidity to the urine deflecting surface 4 once in place on the toilet seat 50.

In another embodiment, the device of the present invention comprises: a sheet material 100 having a folding seam 3, a plurality of attachment tabs 1 and a urine-deflecting surface 4, wherein the plurality of attachment tabs 1 is positioned above and in contact with the folding seam 3, and a urine-deflecting surface 4 positioned below and in contact with the folding seam 3. The folding seam 3 is positioned horizontally along the width of the sheet material 100 thereby separating the plurality of attachment tabs 1 and the urine-deflecting surface 4.

For the purposes of description, reference number 1 in the relevant figures refers to either a single attachment tab or a plurality of attachment tabs. When referring to more than one attachment tab, the phrase "plurality of attachment tabs" is used throughout the specification, unless otherwise indicated. In a particular embodiment of the present invention, the means for attaching the sheet material 100 to the underside of toilet seat 50 comprises an adhesive material 2 applied to each attachment tab 1. Each attachment tab 1 folds down along the folding seam 3 away from the urine deflecting surface 4, to expose the adhesive material 2 to the underside of the toilet seat 50. With each attachment tab 1 folded as described, the sheet material 100 is manually manipulated into a curved configuration, which separates the plurality of attachment tabs 1 as shown in FIG. 4 and FIG. 6. Once in a curved configuration, the sheet material 100 is attached to the underside of the toilet seat 50 by pressing the adhesive material 2 on each attachment tab 1 against the underside of the toilet seat 50. In the curved configuration, the urine deflecting surface 4 is the concave side of the sheet material 100 and faces to the rear of the toilet seat. The flexibility of the sheet material 100 allows for manual manipulation into various curvatures, so as to accommodate the shape of many different toilet seats.

The sheet material 100 preferably has a rectangular configuration. Once the sheet material 100 is attached to the underside of the toilet seat, the dimensions of the urine-deflecting surface 4 are sufficient to block the opening 52 formed between the toilet seat 50 and the toilet bowl 51. Additionally, the dimensions of the urine-deflecting surface 4 are sufficient to avoid contact with the toilet bowl 51 when the toilet seat 50 is lifted to, or lowered from, a vertical position. The dimensions of the sheet material 100 are also sufficient to allow for variations in the lateral direction of a child's urine stream. Further, the sheet material 100 once attached, is not visible to the observer unless the toilet seat 50 is raised, is in an upright vertical position or is viewed from a position to the rear of the attachment point when the toilet seat 50 is down.

DETAILED DESCRIPTION OF THE INVENTION

Figure 8:
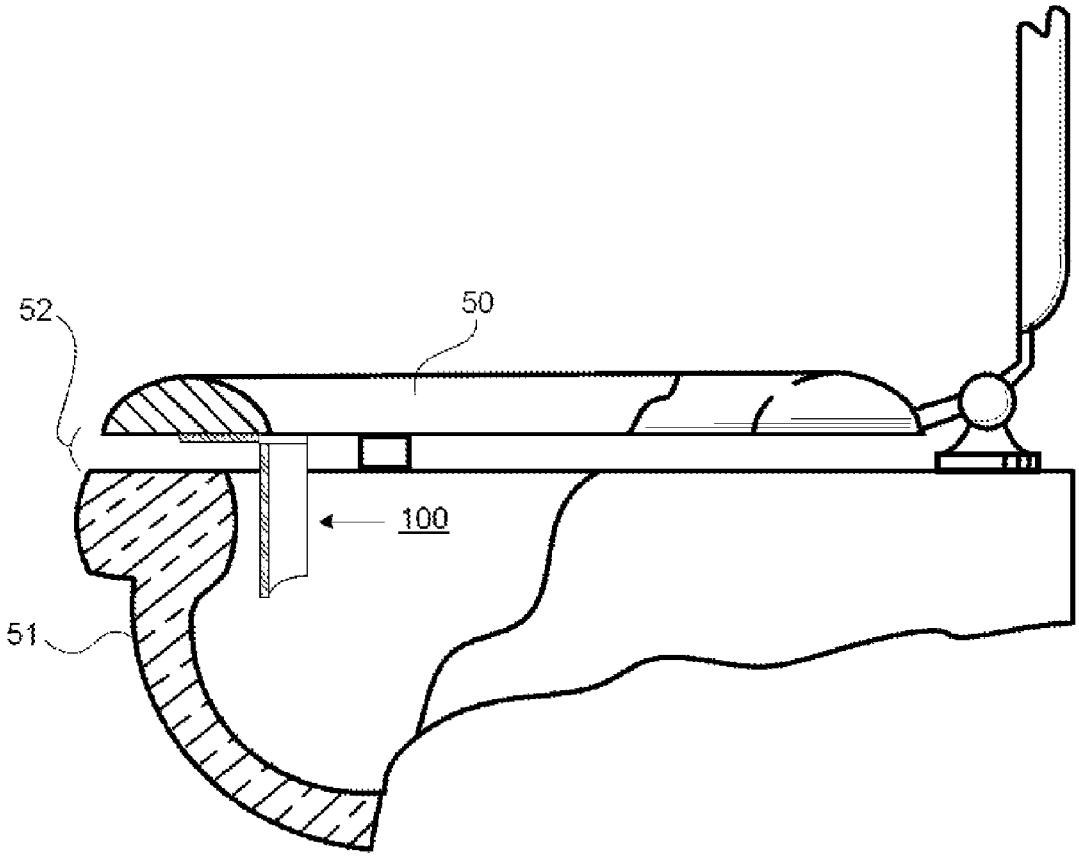
FIG. 8 is a cross-sectional side view of the urine deflector attached to the underside of a toilet seat, as depicted in FIG. 7, taken along the line 8-8.

The potty training device of the present invention comprises a sheet material and a means for attaching said sheet material to the underside of a toilet seat. The sheet material further comprises: a urine-deflecting surface, a folding seam and a plurality of attachment tabs. The present invention is also directed to a potty training device for blocking the opening 52 formed between the toilet seat 50 and the toilet bowl 51, as shown in FIG. 8, wherein the potty training device 100 comprises a sheet material and a means for attaching the potty training device to the underside of a toilet seat, wherein the sheet material further comprises: a urine-deflecting surface, a folding seam and a plurality of attachment tabs.

The present invention is also directed to a potty training device comprising a sheet material, wherein the sheet material comprises a folding seam, a urine deflecting surface, a plurality of attachment tabs and an adhesive material applied to each attachment tab within the plurality of attachment tabs, wherein the adhesive material attaches the sheet material to the underside of a toilet seat.

In one embodiment of the invention, the potty training device is made from a sheet material 100 that is flexible, water-resistant and preferably non-porous. Any material having these characteristics is suitable for the invention. In a particular embodiment of the invention, the sheet material 100 is selected from a rubber or plastic material, wherein a plastic material is particularly preferred. While any plastic material having the above characteristics can be used, the plastic material may be selected from polystyrene films, polyester films, polyacetate films, polyvinyl films, polycarbonate films, polyethylene films, polypropylene films and TEFLON. Preferred plastic materials are: polyester, polycarbonate and polyvinyl films. Examples of suitable polyester films are MELINEX, MYLAR, TEIJIN, TETORON and TEONEX. Examples of suitable polycarbonate films are MAKROFOL and BAYFOL. Examples of suitable polyvinyl films are soft vinyl and ridged vinyl. Mylar and ridged vinyl are particularly preferred plastic materials for the invention.

Another type of plastic that is suitable for the potty training device of the present invention is the type that is used in injection molding processes. Therefore, it is also possible to make the potty training device using an injection molding processes.

The thickness of the sheet material 100 should not compromise its flexibility. Regardless of the thickness and type of sheet material used, it should be flexible enough to readily conform to the curvature of the toilet seat 50 and strong enough to resist tearing or breaking during manipulation and attachment to the underside of the toilet seat. The thickness of the sheet material 100 should also provide rigidity to the urine-deflecting surface 4 when attached to the toilet seat 50. The thickness of sheet material 100 ranges from 0.005-0.025 mils; more specifically, 0.005, 0.006, 0.007, 0.008, 0.009, 0.010, 0.011, 0.012, 0.013, 0.014, 0.015, 0.016, 0.017, 0.018, 0.019, 0.020, 0.021, 0.022, 0.023, 0.024 or 0.025 mils. In a particularly preferred embodiment of the invention, the sheet material 100 is a Mylar film or a ridged vinyl film having a thickness of 0.010, 0.015 or 0.020 mils.

Where the potty training device is made using an injection molding process, the resulting sheet material 100 may have a greater thickness to accommodate the requirements and tolerances associated with making the mold for the product. However, again, the thickness of the resulting sheet material 100, should not compromise its flexibility; thus, any thickness that accomplishes this goal is suitable for the potty training device of the present invention.

While not intending to be limited to any particular thickness for the sheet material 100 resulting from an injection molding process, the thickness of the resulting sheet material 100 may, for example, range from 0.025-0.100 mils. More specifically, a suitable thickness may be selected from 0.025, 0.026, 0.027, 0.028, 0.029, 0.030, 0.031, 0.032, 0.033, 0.034, 0.035, 0.036, 0.037, 0.038, 0.039, 0.040, 0.041, 0.042, 0.043, 0.044, 0.045, 0.046, 0.047, 0.048, 0.049, 0.050, 0.051, 0.052, 0.053, 0.054, 0.055, 0.056, 0.057, 0.058, 0.059, 0.060, 0.061, 0.062, 0.063, 0.064, 0.065, 0.066, 0.067, 0.068, 0.069, 0.070, 0.071, 0.072, 0.073, 0.074, 0.075, 0.076, 0.077, 0.078, 0.079, 0.080, 0.081, 0.082, 0.083, 0.084, 0.085, 0.086, 0.087, 0.088, 0.089, 0.090, 0.091, 0.092, 0.093, 0.094, 0.095, 0.096, 0.097, 0.098, 0.099 and 0.100 mils. The thickness of sheet material 100 may also be increased as necessary, without departing from the spirit of the invention, regardless of the manner in which it is made.

The sheet material 100 preferably has a rectangular shape. For the purpose of defining spatial orientation, the folding seam 3 separates the top portion of the sheet material 100 from the bottom portion. The top portion of the sheet material 100 comprises the plurality of attachment tabs 1 and bottom portion of the sheet material 100 comprises the urine-deflecting surface 4. The height of the sheet material 100 is defined as the length from the top edge of an attachment tab 1 to the bottom edge of the urine-deflecting surface 4. The width of the sheet material 100 is defined as the length from the left edge to right edge of the sheet material 100. The width of the sheet material 100 is greater than its height.

In a particular embodiment of the invention, the entire top portion of the sheet material 100 comprises the plurality of attachment tabs 1, the entire bottom portion of the sheet material 100 comprises the urine-deflecting surface 4 and both the plurality of attachment tabs 1 and the urine-deflecting surface 4 are in contact with the folding seam 3. The bottom corners of the sheet material 100 comprising the urine-deflecting surface 4 may optionally be rounded and the top corners of the sheet material 100 comprising the outermost attachment tabs are preferably squared to provide maximum surface area for the adhesive material 2 thereon.

The width of the sheet material 100 is selected to provide sufficient coverage for the variation in the lateral direction of a child's urine stream. While not intending to be limited to any particular width for the sheet material 100, preferred widths are from 6 -9 inches. The height of sheet material 100 is selected to provide sufficient attachment surface area to the plurality of attachment tabs 1, and allow the urine-deflecting surface 4 to completely block the opening formed between the underside of the toilet seat 50 and the top of the toilet bowl 51. While not intending to be limited to any particular height for sheet material 100, preferred heights range from 1.5-3 inches. In a particular embodiment of the invention, the sheet material 100 has a rectangular dimension of 6 inches by 3 inches or 6 inches by 2 inches.

Figure 1:
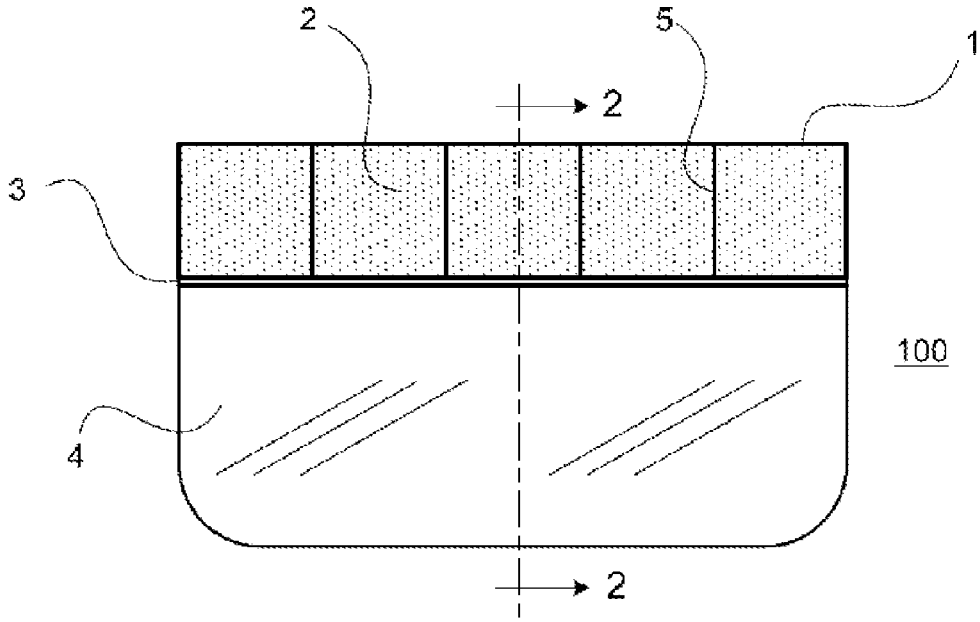
FIG. 1 is a front view of the urine deflector of the present invention, in a flat configuration.
Figure 2:
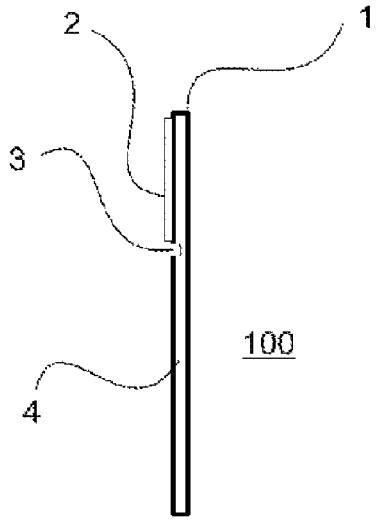
FIG. 2 is a cross sectional view of the urine deflector of the present invention depicted in FIG. 1, taken along line 2-2.

The folding seam 3, as shown in FIG. 1, is linear and extends the full width of the sheet material 100. Where rubber or plastic is selected for sheet material 100, folding seam 3 is prepared using any means known in the art for creating folds in material sheets having the above-mentioned characteristics. While not intending to be limited to any particular method of making the folding seam 3, an example of a suitable method of preparing the folding seam 3 comprises scoring the surface of the sheet material 100 with a cutting tool, such that the resulting cut line does not penetrate the entire thickness of the sheet material 100, as depicted in FIG. 2.

In another example, the folding seam 3 is prepared by linearly perforating the sheet material 100. In still another example, the folding seam 3 is prepared by creating linear depressions in the sheet material 100, such that along the length of the created folding seam 3, the thickness of the sheet material 100 where a depression is formed is less than the thickness of the non-depressed portions of the sheet material 100. The depressions may be positioned on one or both sides of the sheet material 100. Therefore, where a depression method is used, the folding seam 3 may be prepared by making a single contiguous linear depression on one or both sides of the sheet material 100, or by making a plurality of individual linearly arranged depressions on one or both sides of the sheet material 100.

As depicted in FIG. 1, the sheet material 100 further comprises a plurality of attachment tabs 1, wherein each attachment tab 1 is in contact with the folding seam 3. Additionally, adjacent attachment tabs 1 are separated by a linear cut 5 in the sheet material 100. Each linear cut 5 passes through the entire thickness of the sheet material 100, and is perpendicular to, and terminates at the folding seam 3.

Further, each adjacent attachment tab 1 may optionally be separated by a gap that is wider than the thickness of linear cut 5. For example, where an injection mold process is used to make the urine-deflector of the present invention, the mold's manufacturing specifications may require that there be a larger distance between each adjacent attachment tab, due to physical requirements and constraints associated with making the mold. The size of any gap between adjacent attachment tabs 1 should not, however, compromise the functionality of the sheet material 100 as described herein, including the ability of sheet material 100 to stay attached to the toilet seat once in place and during use.

The sheet material 100 of the present invention may comprise any number of attachment tabs 1. Depending on the size of the sheet material 100, from 4-10 attachment tabs 1 are preferred. An odd number of attachment tabs 1 is particularly preferred, because the center attachment tab provides a visual reference point for centering the sheet material at the attachment point on the underside of the toilet seat 50. Thus, in a particular embodiment of the invention, 5, 7 or 9 attachment tabs 1 are preferred.

For a given sheet material 100, all attachment tabs preferably have the same dimensions and are evenly distributed across the width of the sheet material 100. The height of each attachment tab 1 preferably is from one-third to one-half the height of the sheet material 100. The "height of the attachment tab" is defined as the length from the top edge of the attachment tab 1 to the folding seam 3. In a particular embodiment of the invention, the height of the attachment tab 1 is 1.0 inch.

Figure 3:
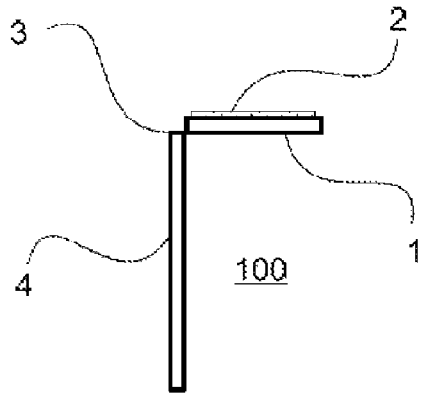
FIG. 3 is the cross sectional view of the urine deflector of the present invention shown in FIG. 2, with the attachment tab folded down, thereby resulting in the sheet material 100 having an L-shaped configuration.
Figure 4:
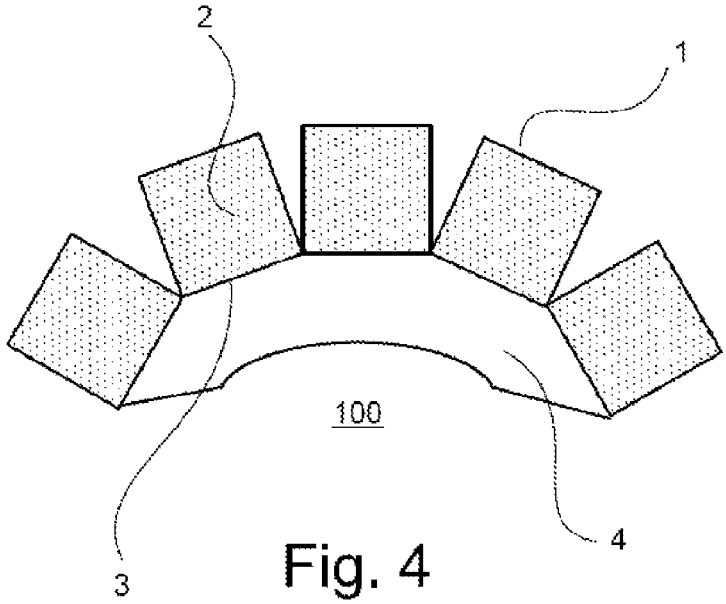
FIG. 4 is a top view of the urine deflector of the present invention in a curved configuration, showing separation of the top corners of adjacent attachment tabs.

In order to attach the sheet material 100 to the underside of the toilet seat, an adhesive material 2 is applied on each attachment tab 1. Such application can be by any suitable means, for example, by coating or printing, and the adhesive is, preferably, applied as a solid layer, although it is also possible to applying the adhesive in a pattern of discrete islands of adhesive, for example, in the form of dots or squares or other shapes, as is well known in the adhesive art. The attachment tab 1 is folded away from the urine-deflecting surface 4 along the folding seam 3, as shown in FIG. 3, resulting in the sheet material 100 having an L-shaped configuration. Once in the L-shaped configuration, the sheet material 100 is then manipulated into a curved configuration such that the top corners of adjacent attachment tabs 1 separate as shown in FIG. 4. In this curved configuration the adhesive material is applied to the underside of the toilet seat by pressing the attachment tabs 1 against the seat, thereby attaching the sheet material 100 to the toilet seat.

While any means for attaching the potty training device to the underside of a toilet seat 50 can be used, an adhesive material 2 is preferred. The adhesive material 2 is a pressure-sensitive adhesive strip or resin that is applied to each attachment tab 1 and once applied to the underside of the toilet seat 50, is preferably strong enough to hold the sheet material 100 in place until physically removed by the consumer and not damage the finish of the toilet seat 50 during removal.

Figure 12:
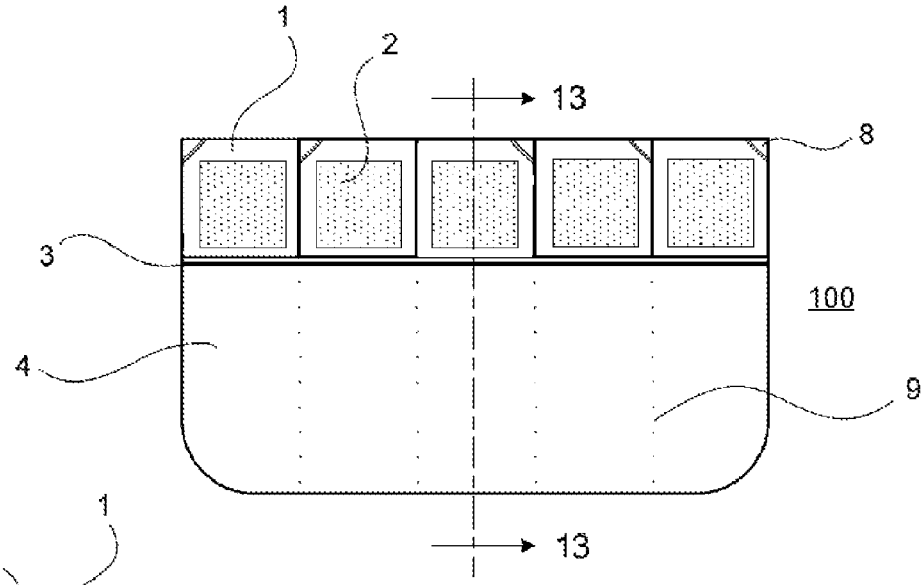
FIG. 12 is a front view of the urine deflector of the present invention, in a flat configuration, showing an alternative embodiment of each attachment tab 1 having a release tab 8.

In order to assist with removal of the sheet material 100 from the toilet seat, in another embodiment, each attachment tab 1 may comprise one or more release tabs 8, as shown in FIG. 12. The release tab 8 is formed by folding down a small section of the attachment tab 1 along a folding seam, which may be the same or similar to the folding seam 3, previously described. FIG. 12 shows the release tabs 8 positioned at the corners of each attachment tab 1. The location of the release tab 8 is not critical, so long as it does not compromise the functionality of the urine-deflector as described herein. Alternatively, the release tab 8 may be positioned at the upper portion of the attachment tabs 1 such that the folding seams provided for the release tabs 8 are parallel to previously described folding seam 3. Regardless of the configuration of this embodiment, the adhesive material is not applied to the release tab 8.

Therefore, regardless of the position of the release tab 8 on attachment tab 1, the consumer should be able to remove the sheet material 100 by grasping the release tab 8 between their thumb and index finger and pulling successive attachment tabs 1 from the toilet seat. Once removed from the toilet seat, the sheet material 100 may be discarded in the trash or, if made of a suitable material, it may be flushed down the toilet.

While not intending to be limited to any particular type of adhesive material, a suitable adhesive material is manufactured by 3M Corporation under the trade name Poster Tape. Regardless of the type of adhesive material used, it is applied to the surface of each attachment tab 1, as shown in FIG. 2 and FIG. 12, and may optionally cover the entire surface area each attachment tab 1.

Figure 5:
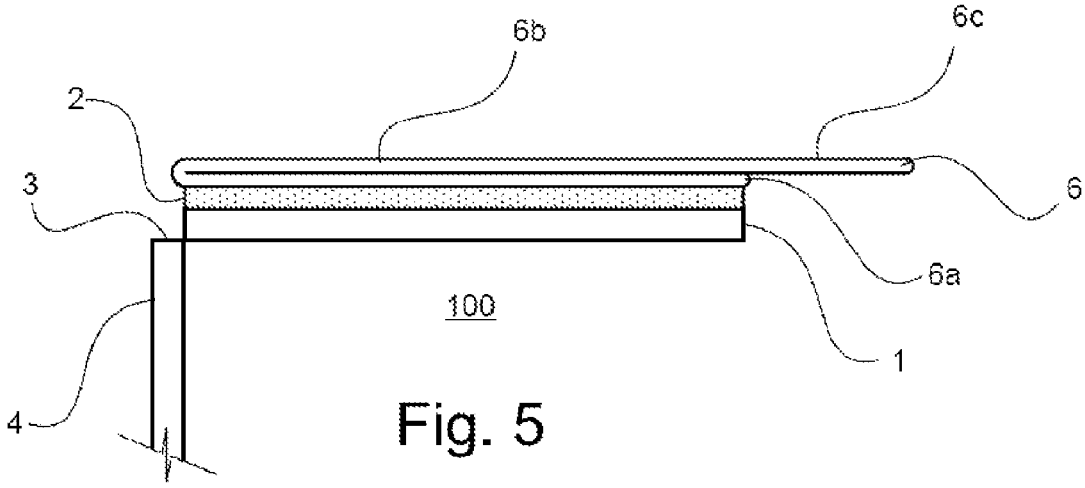
FIG. 5 is the cross sectional view of the urine defector of the present invention shown in FIG. 3, having a protective covering applied to the adhesive layer.
Figure 6:
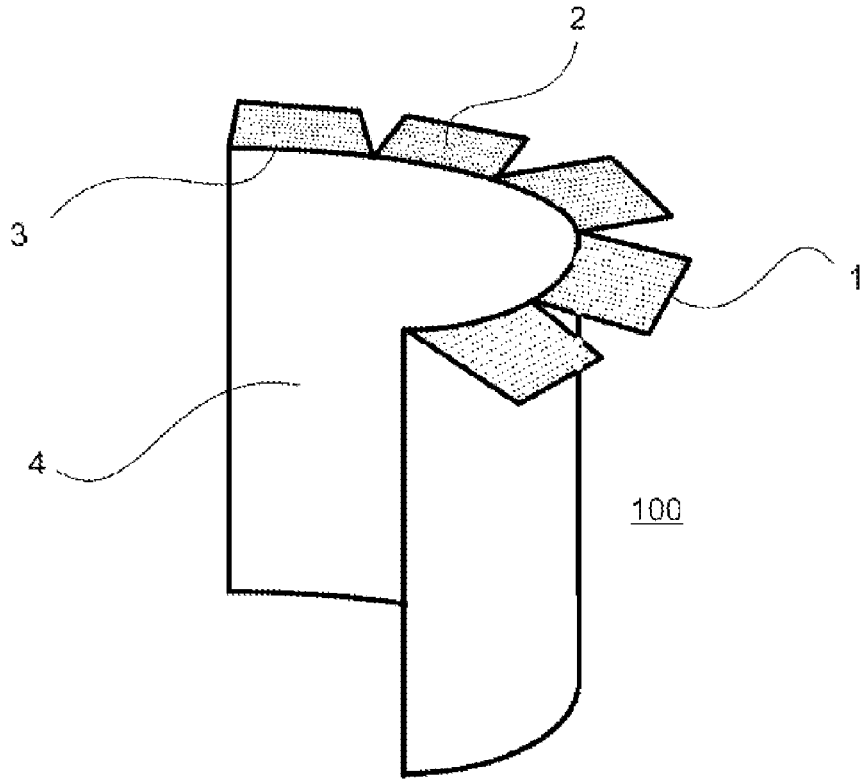
FIG. 6 is a plan view of the urine deflector depicted in FIG. 4.
Figure 7:
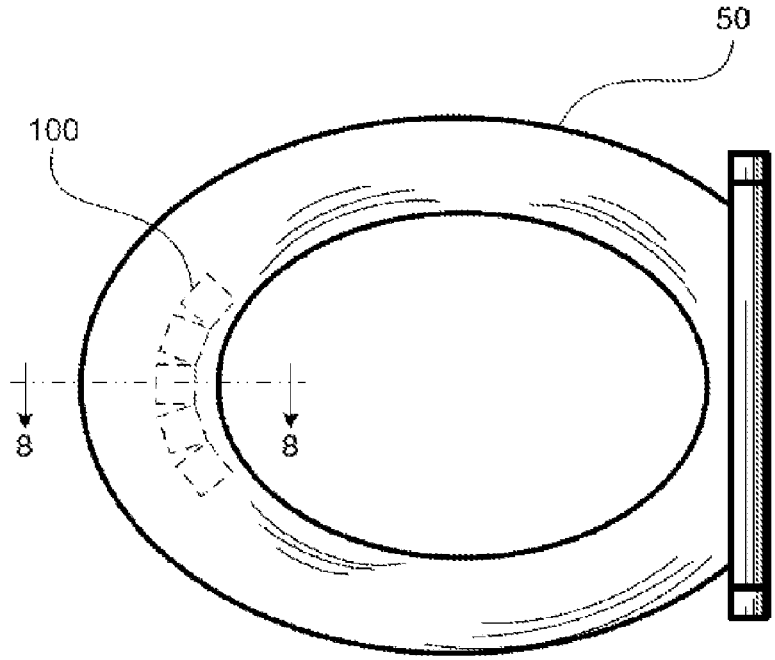
FIG. 7 is top view of the urine deflector depicted in FIG. 4, attached to the underside of a toilet seat.

A removable protective covering 6 may also be applied to the surface of the adhesive material 2. In a particular embodiment, the removable protective covering 6 is configured to form a removal tab 6*c*, as shown in FIG. 5. For this particular embodiment the length of each removable protective covering 6 is preferably from 2.25-3.00 times the length of the adhesive material 2. The length of the adhesive material 2 on an attachment tab 1 is defined as the distance from the edge of the adhesive material 2 near the top edge of the attachment tab 1 to the edge of the adhesive material 2 near the folding seam 3.

As shown in FIG. 5, the removable protective covering 6 comprises a lower layer 6*a* and an upper layer 6*b*. The lower layer 6*a* is applied to the surface of the adhesive material 2 in a direction starting from the top of an attachment tab 1, towards the folding seam 3. At the folding seam 3, the lower layer 6*a* is folded back on itself, thereby creating upper layer 6*b*, which is applied to the top of lower layer 6*a* and extends past the top of the attachment tab 1. The portion of the upper layer 6*b* extending beyond the top of the attachment tab 1 forms a removal tab 6*c*, that when pulled, exposes the surface of the adhesive material 2 to the underside of the toilet seat 50.

The sheet material 100 is attached to the underside of the toilet seat 50 by:

folding the plurality of attachment tabs 1 down and away from the urine deflecting surface 4 along the folding seam 3, resulting in the sheet material 100 having an L-shaped configuration;

while in the L-shaped configuration, bending the left and right edges of the urine-deflecting surface 4 inward such that the top corners of adjacent attachment tabs 1 separate; and pressing the adhesive material 2 applied to each attachment tab 1 against the underside of the toilet seat 50 at a desired attachment location, such that the curvature of the sheet material matches the curvature of the toilet seat 50.

Alternatively, the sheet material 100 can be formed into a curved configuration during sequential attachment of individual attachment tabs 1. In a preferred embodiment, the center attachment tab 1 is positioned at the desired location on toilet seat 50, followed by removal of the protective covering 6 by pulling removal tab 6*c*, thereby exposing the adhesive material 2 to the underside of the toilet seat, and securing the attachment tab 1 thereto. This process is repeated, wherein the sheet material 100 is bent to individually position remaining attachment tabs 1 in a curved configuration prior to removal of the protective covering 6.

Figure 9:
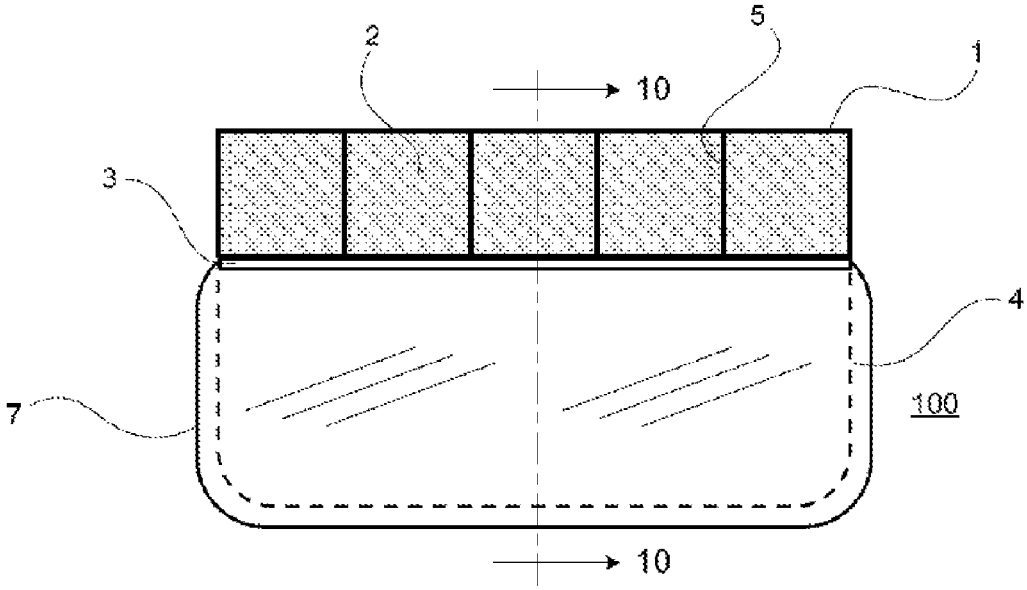
FIG. 9 is a front view of the urine deflector of the present invention, in a flat configuration, showing an additional sheet material applied to the urine-deflecting surface wherein the left, right and bottom edges of the additional sheet material extend beyond the left, right and bottom edges of the urine-deflecting surface.
Figure 10:
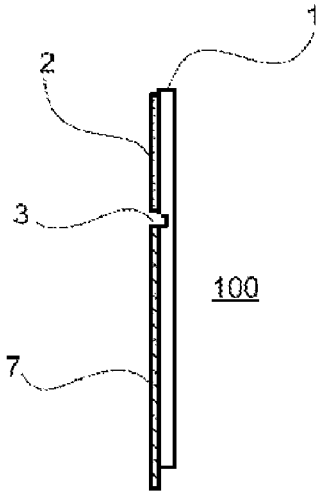
FIG. 10 is a cross sectional view of the urine deflector of the present invention depicted in FIG. 9, taken along lines 10-10.
Figure 11:
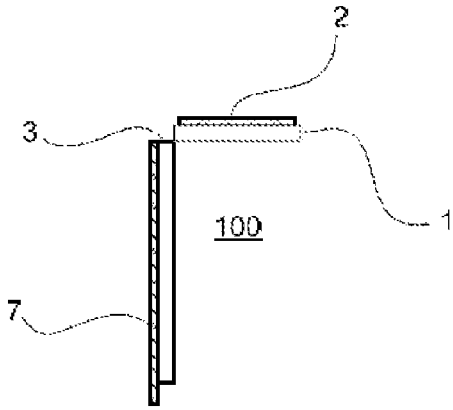
FIG. 11 is the cross sectional view of the urine deflector shown in FIG. 10, with the attachment tab folded down, thereby resulting in the sheet material 100 having an L-shaped configuration.

In another embodiment of the invention, as shown in FIGS. 9, 10 and 1, sheet material 100 further comprises an additional sheet material 7, that is laminated onto the urine-deflecting surface 4, wherein the left, right and bottom edges of the additional sheet material 7 extend beyond the left right and bottom edges of the urine-deflecting surface 4. For this particular embodiment, the additional sheet material 7 is a softer material than sheet material 100 and is preferably a soft vinyl film.

In another embodiment of the present invention, the sheet material 100 may be transparent, having a tinted or clear color. The transparent characteristic of the sheet material 100 facilitates easy cleaning, since the consumer can see the areas that need direct cleaning from a standing position when the toilet seat 50 is in a vertical position.

To further assist in maintaining the sanitary condition of the urine-deflecting device of the present invention, the sheet material 100 may also be treated with any compound that inhibits the formation of odor, bacteria, mold or other urine associated growth. The sheet material 100 may also be a medical grade type material, such as a medical grade plastic for example, that is also resistant to the formation of odor, bacteria, mold or other urine associated growth.

In another embodiment of the present invention, the potty training device is flushable. In order to accommodate this specific characteristic, the potty training device comprises a sheet material 100 that is made from one or more biodegradable and/or water-disbursable materials.

In one embodiment of the flushable version of the potty training device of the present invention, the sheet material 100 is made from a biodegradable plastic material and the adhesive 2 is also made of a biodegradable material. The biodegradable material should be water-insoluble to prevent dissolution or degradation of the device or the adhesive material holding it in place during use. This version of the potty training device can be prepared using an injection molding process, biodegradable films or combinations thereof.

In another embodiment of the flushable version of the potty training device of the present invention, the device comprises a combination of a water-soluble and/or water-dispersible core material 10, that is surrounded by a water-insoluble biodegradable material outer coating or laminate 11. The water-insoluble outer coating or laminate 11 may contain an amount of a water-soluble or water-dispersible material in order to facilitate the degradation or decomposition of the biodegradable outer coating or laminate 11, when in constant contact with a water source, such as in the toilet bowl or sewer line. It is desirable, however, that there be no significant degradation of the outer coating or laminate 11 of this embodiment during its use, until flushed by the consumer.

Therefore, the use of a water-insoluble biodegradable outer-coating or laminate 11, containing an amount of water-soluble or water-disbursable material may be used to control the amount of time that the potty training device is used by the consumer. For example, a color indicating material may be incorporated into a mixture of a water-insoluble biodegradable material and water-soluble or water-disbursable material, wherein as the water-soluble or water-disbursable component dissolves (or disburses) from contact with the user's urine stream, the color indicator becomes visible, thereby indicating to the consumer that the potty training device should be replaced. Thus, the duration of use for the potty training device may be controlled by the amount of water-soluble or water-disbursable material present within the water-insoluble biodegradable material.

In order to ensure that the sheet material 100 has a size that is suitable for flushing down a variety of toilet openings without creating obstructions within the plumbing, the sheet material 100 may optionally have a plurality of tearing perforations 9, positioned vertically on the urine deflecting surface 4 and between adjacent attachment tabs 1, as shown in FIG. 12. Since the attachment tabs 1, are positioned away from the urine-deflecting surface 4, they do not come in contact with the urine stream. Therefore, upon removal of the potty training device from the toilet seat using the removal tabs 8, the consumer may hold adjacent attachment tabs 1 (one between the thumb and forefinger of each hand), and tear downward through the urine-deflecting surface 4. The resulting sections may be dropped into the toilet bowl and flushed away.

Where the flushable version of the potty training device of the present invention is made of a biodegradable water-insoluble plastic material, the torn fragments thereof will begin to decompose in the sewer system as a result of breakdown of the biodegradable material by microorganisms. Where the potty training device has a core made of a water-dispersible or water-soluble core material 10, covered by a water-insoluble biodegradable outer coating or laminate 11, tearing of the potty training device, as described above, breaks the water-insoluble outer coating 11, and exposes the water-soluble or water-dispersible core material 10 to water in the toilet bowl. Therefore, the decomposition of the core material 10 begins in the toilet bowl via capillary action or osmosis, and once flushed, continues in the sewer line with the biodegradable outer coating or laminate 11. In this particular configuration, the core material 10 comprises the majority of the device thickness, however, the thickness of either of the outer coating or laminate 11 or core material 10 can comprise the majority of the thickness of sheet material 100; the choice of the thicker component would be determined by the choice of materials used to obtain the desired functional characteristics for the potty training device.

Figure 13:
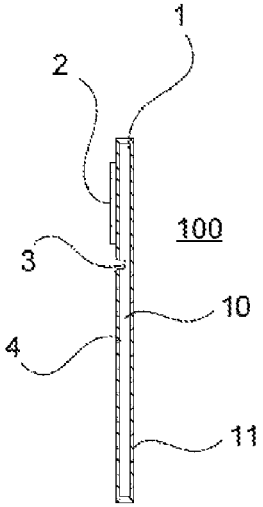
FIG. 13 is a cross-sectional view of the urine deflector shown in FIG. 12, taken along the line 13-13, showing the sheet material 100 having a fluid-resistant coating 9.
Figure 14:
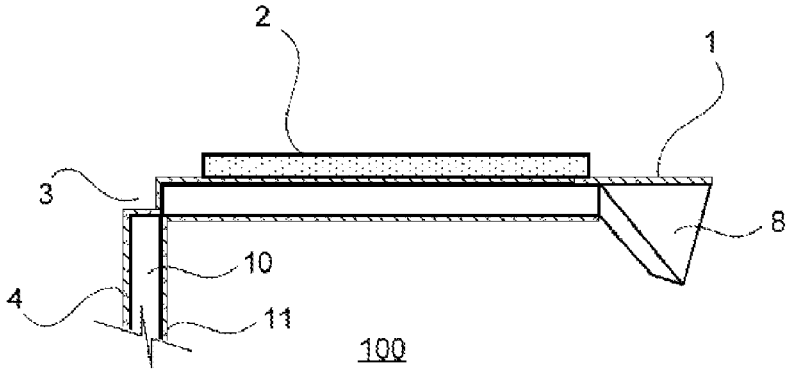
FIG. 14 is a cross-sectional view of the urine deflector in an L-shaped configuration, showing the fluid-resistant coating 9 and the release tab 8 folded down.

The core material 10 must also have the desired flexibility and strength to bend and conform to the curvature of the toilet seat, as well as bend about the folding seam 3 without tearing. The water-insoluble biodegradable outer coating or laminate 11, should have a suitable thickness to cover the core material 10, as shown in FIGS. 13 and 14, in order to render the potty training device water resistant. Any thickness that obtains the desired water-resistance, without compromising flexibility and strength is preferred.

Suitable materials for use as core material 10 include, but are not limited to: water-soluble, water-dispersible and/or biodegradable paper, recycled paper, paperboard, cardboard or combinations thereof; water-soluble and/or biodegradable thermoplastic polymers, including but not limited to: hydroxypropyl cellulose, polyethylene oxide, polypropylene oxide, polyvinyl alcohol and polyvinyl alcohol copolymers, polyvinylpyrollidone, polyvinyl pyridine, gelatinized starch, and interpenetrated networks of starch with ethylene/vinyl alcohol copolymers disclosed in U.S. Pat. No. 5,391,423 (Wnuk et al), issued Feb. 21, 1995 (herein incorporated by reference), nylon copolymers, acrylic acid copolymers, polyethylene glycol, as well as compatible mixtures and blends of these polymers. Particularly preferred water-soluble polymers for use in the present invention include polyethylene oxide available from Union Carbide under the Polyox N-80 designation (Mw 200,000) and polyvinyl alcohol available from Air Products under the Vinex 2034, 2025 and 5030 designations.

Water-insoluble biodegradable polymers useful in the present invention as outer-coatings or laminates 11 include, but are not limited to: nitrocellulose polymers; poly(lactic acid) polymers; polycaprolactones disclosed in U.S. Pat. No. 5,391,423 (Wnuk et al), issued Feb. 21, 1995 (herein incorporated by reference); aliphatic polyalkylene succinate polymers, polyalkylene succinate adipate copolymers or mixtures thereof disclosed in U.S. Pat. No. 5,849,401 (El-Afandi et al), issued Dec. 15, 1998 and U.S. Pat. No. 5,910,545 (Tsai et al), issued Jun. 8, 1999 (herein incorporated by reference); polyhyroxyalkanoate polymers and copolymers including polyhydroxybutyrate polymers and polyhydroxybutyrate/valerate copolymers disclosed in U.S. Pat. No. 5,391,423 (Wnuk et al), issued Feb. 21, 1995 (herein incorporated by reference), and poly(3-hydroxybutyrate-co-3-hydroxhexanoate), poly(3-hydroxybutyrate-co-3-hydroxyoctanoate), poly(3-hydroxybutyrate-co-3-hydroxynonanoate), poly(3-hydroxybutyrate-co-3-hydroxydecanoate), poly(3-hydroxybutyrate-co-3-hydroxydocosanoate), poly(3-hydroxybutyrate-co-3-hydroxyhexadecanoate), poly(3-hydroxyvalerate-co-3-hydroxyoctanoate), poly(3-hydroxybutyrate-co-3-hydroxyvalerate-co-3-hydroxyoctanoate), poly(3-hydroxybutyrate-co-3-hydroxyvalerate-co-3-hydroxydecanoate), and poly(3-hydroxybutyrate-co-3-hydroxyvalerate-co-3-hydroxyoctanoate-co-3-hydroxydecanoate) copolymers disclosed in U.S. Pat. No. 5,489,470 (Noda), issued Feb. 6, 1996 and U.S. Pat. No. 5,498,692 (Noda), issued Mar. 12, 1996 (herein incorporated by reference); aliphatic-aromatic copolyesters preferably comprising 10 to 1000 repeating units, most preferably from 15 to 600 repeating units, disclosed in U.S. Pat. No. 5,292,783 (Buchanan et al), issued Mar. 8, 1994, U.S. Pat. No. 5,446,079 (Buchanan et al), issued Aug. 29, 1995, U.S. Pat. No. 5,559,858 (Buchanan et al), issued Feb. 4, 1997, and U.S. Pat. No. 5,580,911 (Buchanan et al), issued Dec. 3, 1996 (herein incorporated by reference) that are prepared from combinations of dicarboxylic acids or derivatives thereof including those selected from malonic, succinic, glutaric, adipic, pimelic, azelaic, sebacic, fumaric, 2,2-dimethyl glutaric, suberic, 1,3-cyclopentanedicarboxylic, 1,4-cyclohexanedicarboxylic, 1,3-cyclohexanedicarboxylic, diglycolic, itaconic, maleic, 2,5-norbornanedicarboxylic, 1,4-terephthalic, 1,3-terephthalic, 2,6-naphthoic, and 1,5-naphthoic acid, and ester forming derivatives thereof, and combinations thereof, and diols selected from ethylene glycol, diethylene glycol, propylene glycol, 1,3-propanediol, 2,2-dimethyl-1,3-propanediol, 1,3-butanediol, 1,4-butanediol, 1,5-pentanediol, 1,6-hexanediol, 2,2,4-trimethyl-1,6-hexanediol, thiodiethanol, 1,3-cyclohexanedimethanol, 1,4-cyclohexanedimethanol, 2,2,4,4-tetramethyl-1,3-cyclobutanediol, triethylene glycol, tetraethylene glycol, and combinations thereof; aliphatic polyesteramides disclosed in U.S. Pat. No. 5,644,020 (Timmermann et al), issued Jul. 1, 1997 (herein incorporated by reference) that are prepared from various combinations of diols such as ethylene glycol, 1,4-butanediol, 1,3-propanediol, 1,6-hexanediol, and diethylene glycol, dicarboxylic acids such as oxalic acid, succinic acid, and adipic acid (or their respective esters), hydroxycarboxylic acids and lactones such as caprolactone, aminoalcohols such as ethanolamine and propanolamine, cyclic lactams such as epsilon-caprolactam or lauric lactam, omega-aminocarboxylic acids such as aminocaproic acid, mixtures (1:1 salts) of dicarboxylic acids such as adipic acid and succinic acid and diamines such as hexamethylenediamine and diaminobutane, and hydroxy-terminated or acid-terminated polyesters with molecular weights from about 200 to about 10,000; as well as compatible mixtures or blends of these polymers, such as, for example, poly(tetramethylene succinate-co-terephthalate) copolyesters, poly(tetramethylene glutarate-co-terephthalate) copolyesters, poly(tetramethylene terephthalate-co-diglycolate) copolyesters, poly(tetramethylene glutarate-co-naphthalate) copolyesters and poly(tetramethylene) adipate-co-terephthalate copolyesters.

Particularly preferred water-insoluble biodegradable polymers for use in the present invention that are relatively easy to process into films by conventional techniques and have particularly desirable mechanical properties include: nitrocellulose polymers; poly(lactic acid) polymers; polycaprolactones; aliphatic polyalkylene succinate polymers, polyalkylene succinate adipate copolymers or mixtures thereof; aliphatic-aromatic copolyesters; and polyesteramides. Aliphatic polyalkylene succinate polymers, polyalkylene succinate adipate copolymers or mixtures thereof that are particularly preferred for use in the present invention include polybutylene succinate polymers and polybutylene succinate adipate copolymers having weight-averaged molecular weights (Mw) of from about 40,000 to about 300,000 with a degree of polydispersity (Mw/Mn) in the range of from about 1.8 to about 3.6 and are available from Showa Highpolymer Co. Ltd, Tokyo, Japan, under the Bionolle Type 1000 and 3000 designations. Aliphatic-aromatic copolyesters that are particularly preferred for use in the present invention include poly(tetramethylene) adipate-co-terephthalate copolyesters available from Eastman Chemical under the Eastar Biodegradable Copolyester 14776 designation. Aliphatic polyesteramides that are particularly preferred for use in the present invention include those prepared from combinations of adipic acid, butanediol or hexanediol, and aminocaproic acid or epsilon-caprolactam, having averaged molecular weights (Mw) of from about 50,000 to about 200,000 that are available from Bayer under the BAK 402, 403 and 404 designations.

The above-mentioned biodegradable, water-soluble and/or water-dispersible polymers may be injection molded or extruded into films or sheets to make the components of the flushable version of potty training device of the present invention.

Suitable pressure-sensitive adhesives (PSA) 2 for the flushable version of the present invention are preferably biodegradable and water-resistant, so as to allow the potty training device to stay in place for an extended period of use. Such adhesives should be strong enough to remaining in place until removed by the consumer, detach from the toilet seat without leaving significant residue and not remove the finish on the toilet seat during removal. It may be desirable for the PSA to dissolve over a period of time and thereby determine or control the frequency of replacement by the consumer. The adhesive may therefore also contain an amount of a water-soluble adhesive or water-soluble adhesive component to control the dissolution rate of the adhesive.

Preferred biodegradable water-resistant PSAs suitable for the flushable version of the present invention include, but are not limited to: rubber-based and acrylic-based adhesives. While not being limited to any particular biodegradable water-resistant rubber-based adhesives, examples of suitable rubber-based adhesives are those made from mixtures of synthetic or natural rubber and at least one tackifier resin selected from the group consisting of rosin, derivatives of rosin (e.g., hydrogenated rosin, disproportionated rosin, polymerized rosin and rosin ester), terpene, and derivatives of terpene (e.g., .alpha.-pinene resin, .beta.-pinene resin, dipentene resin and hydrogenation products of these resins). The natural rubber may be in the form of either a solid or latex. In the adhesive, the tackifier resin is preferably used in an amount of 1 to 150 parts by weight based on 100 parts by weight of the natural rubber.

The invention has been described in terms of illustrative embodiments. It will be understood by those of ordinary skill in the art that various modifications and changes may be made to these embodiments without departing from the spirit or scope of the invention. It is intended that the invention not be limited in any manner by the embodiments shown and described herein.

What is claimed is:

1. A potty training device comprising:

a flexible sheet material having a top portion, a bottom portion, a left edge and a right edge;

a folding seam in said flexible sheet material to permit folding of said flexible sheet material about the folding seam, wherein said folding seam extends horizontally between said left edge and said right edge of said flexible sheet material and separates the said top portion of said flexible sheet material from said bottom portion of said flexible sheet material; and a means for attaching said flexible sheet material to the underside of a toilet seat in such a way that after attaching said flexible sheet material to the underside of said toilet seat by said means for attaching the flexible sheet material hangs entirely beneath the underside of said toilet seat, wherein said means for attaching is located within said top portion of said flexible sheet material, and further wherein said bottom portion of said flexible sheet material when folded about said folding seam can be positioned to block an opening formed between the toilet seat and a toilet bowl to which said toilet seat is attached, and wherein a surface of said bottom portion serves as a urine-deflecting surface to deflect a urine stream directed towards said opening into the toilet bowl.

2. The potty training device according to claim 1, wherein said means for attaching said flexible sheet material to the underside of a toilet seat comprises an adhesive material applied to a plurality of attachment tabs.

3. The potty training device according to claim 2, wherein each attachment tab within said plurality of attachment tabs further comprises a release tab.

4. The potty training device according to claim 2, wherein said flexible sheet material comprises a biodegradable material, a water-soluble material, water-disbursable material, or combinations thereof.

5. The potty training device according to claim 4, wherein said flexible sheet material further comprises a core material and an outer coating or laminate material covering said core material.

6. The potty training device according to claim 5, wherein said core material is a water-soluble or water-disbursable material and said outer coating or laminate material is water-insoluble.

7. The potty training device according to claim 6, wherein said core material is selected from the group consisting of: paper, paper fibers, recycled paper, paperboard, cardboard, a thermoplastic polymer, a mixture of thermoplastic polymers and combinations thereof.

8. The potty training device according to claim 7, wherein said outer coating or laminate material is a biodegradable polymer or mixture thereof.

9. The potty training device according to claim 8, wherein said adhesive material is a water-resistant biodegradable pressure-sensitive adhesive resin or water-resistant biodegradable pressure-sensitive double-sided tape.

10. The potty training device according to claim 9, wherein said flexible sheet material further comprises a plurality of tearing perforations or tearing seams.

11. The potty training device according to claim 10, wherein said flexible sheet material is flushable.

12. The potty training device according to claim 11, wherein each attachment tab within said plurality of attachment tabs further comprises a release tab.

13. A method of potty training comprising:

providing a potty training device according to claim 1;

folding the flexible sheet material about said folding seam;

attaching the device to the underside of a toilet seat with the aid of said means in such a way that after attaching said flexible sheet material to the underside of said toilet seat by said means for attaching the flexible sheet material hangs entirely beneath the underside of said toilet seat and in a position to block an opening formed between the toilet seat and a toilet bowl to which said toilet seat is attached so that the urine-deflecting surface deflects a urine stream directed towards said opening into the toilet bowl.

14. The method according to claim 13, wherein attaching said device to the underside of a toilet seat comprises:

bending said plurality of attachment tabs down and away from said urine-deflecting surface along said folding seam resulting in the sheet material having an L-shaped configuration;

while in said L-shaped configuration, bending the left and right edges of said urine-deflecting surface inward such that said plurality of attachment tabs separate; and pressing said adhesive material on said separate attachment tabs against the underside of a toilet seat such that the curvature of the sheet material matches the curvature of the said toilet seat.

15. A method of potty training comprising:

providing a potty training device according to claim 2;

folding the flexible sheet material about said folding seam;

attaching the device to the underside of a toilet seat with the aid of said adhesive material in such a way that after attaching said flexible sheet material to the underside of said toilet seat with the aid of said adhesive material the flexible sheet material hangs entirely beneath the underside of said toilet seat and in a position to block an opening formed between the toilet seat and a toilet bowl to which said toilet seat is attached so that the urine-deflecting surface deflects a urine stream directed towards said opening into the toilet bowl.

* * * * *